US006234471B1

(12) United States Patent
Tranquilla

(10) Patent No.: US 6,234,471 B1
(45) Date of Patent: May 22, 2001

(54) DOCUMENT JOGGER WITH ADJUSTABLE BIN WIDTH

(75) Inventor: Michael N. Tranquilla, Livonia, MI (US)

(73) Assignee: Unisys Corporation, Blue Bell, PA (US)

( * ) Notice: Subject to any disclaimer, the term of this patent is extended or adjusted under 35 U.S.C. 154(b) by 0 days.

(21) Appl. No.: 09/353,464

(22) Filed: Jul. 13, 1999

Related U.S. Application Data

(60) Provisional application No. 60/092,494, filed on Jul. 13, 1998.

(51) Int. Cl.[7] ..... B65H 1/02
(52) U.S. Cl. ..... 271/149; 271/171
(58) Field of Search ..... 271/146, 189, 271/171, 210, 220; 366/111, 114

(56) References Cited

U.S. PATENT DOCUMENTS

| | | | | |
|---|---|---|---|---|
| 3,061,303 | * | 10/1962 | Glaser et al. | 271/171 |
| 3,198,519 | * | 8/1965 | Bartsch | 271/210 |
| 4,345,753 | * | 8/1982 | Marshall | 271/146 |
| 5,044,877 | * | 9/1991 | Constant et al. | 271/149 |
| 5,622,269 | * | 4/1997 | Seymour et al. | 271/210 |

FOREIGN PATENT DOCUMENTS

| | | | | |
|---|---|---|---|---|
| 1 183 915 | * | 12/1964 | (DE) | 271/146 |

* cited by examiner

*Primary Examiner*—Christopher P. Ellis
*Assistant Examiner*—Mark A. Deuble
(74) *Attorney, Agent, or Firm*—Mark T. Starr; Harness Dickey & Pierce

(57) ABSTRACT

A document jogger having an adjustable bin for receiving document stacks of variable length.

9 Claims, 2 Drawing Sheets

DOCUMENT JOGGER WITH ADJUSTABLE BIN WIDTH

RELATED APPLICATION

This application claims priority from Provisional Application Serial No. 60/092,494 filed Jul. 13, 1998.

BACKGROUND

1. Technical Field

This invention relates generally to document joggers, and more particularly to a document jogger having an adjustable bin.

2. Discussion

In commerce, documents of various sizes and grades are generated as a result of transactions. For example, in the financial services industry thousands of checks clear on a daily basis. These checks are processed so that the appropriate funds can be transmitted from one institution to another. In performing this task, various types of processing equipment are used. In order to be reliably operated on by the processing equipment, documents such as checks when fed into the processing equipment must be aligned along their leading and bottom edges. One way of doing this is to use a document jogger. A document jogger has the function of aligning documents along their leading and bottom edges by vigorously vibrating the documents, which are stacked in a bin, so that their inter document friction lock is broken and the documents fall into alignment.

Referring to FIG. 1, a document jogger known in the art is illustrated. The document jogger 10 has a base 12. The base 12 supports a housing 14 that is suspended from the base 12 by springs. The housing 14 has a column 13 that is mounted to a deck 16. The deck 16 has mounted to it a wall 17 which forms a vee at its juncture with a bottom wall or base 21 of the deck 16. The deck 16 also has mounted to it a plurality of fixed walls 24 that, in conjunction with wall 17 and base 21, define bins 18. The bins 18 are adapted to hold a stack of documents 22 of various sizes and grades that are sufficient in number to be held in the adult human hand. The jogger 10 can have a plurality of bins 18 depending upon the jogging time and number of documents being processed. Although it is known in the art to have as many as twelve bins employed, it is most common to have four bins for use with, for example, check processing equipment.

In operation, the jogger 10 is controlled by a control mechanism 11 which when actuated powers an electromagnet that is rigidly fastened to the base 12. The electromagnet excites the housing 14 with an alternating magnetic field causing the housing 14 to vibrate on its spring suspension vertically. The deck 16, which is rigidly mounted to the housing 14 by way of the column 13, vibrates with the housing 14. The amplitude of the vibration is approximately 0.05 inch peak-to-peak, and its frequency is usually 60 hertz. To facilitate alignment along the leading and bottom edges of the documents 22, the deck 16 is mounted at an angle in relation to the column 13 such that in operation, vertical vibration causes the documents 22 to settle into the vee formed at the juncture of the wall 17 and the base 21.

In operation, problems can occur at the end of a check processing run when, for example, a smaller than desirable batch of documents is placed into a bin 18. This happens more frequently, for example, at smaller community banks which receive their deposited checks periodically. When a batch of documents 22 does not completely fill the bin 18, it is known that the documents may fall onto their side during operation of the jogger, and may then fall through a debris slot 20 in the wall 17. It is also known that if the documents 22 do not fall through the debris slot 20, the documents 22 laying on their side cannot be properly jogged resulting in improper alignment and difficulties in processing. To prevent this, operators have supported smaller batches with their hands. In doing so, this prevents an operator from performing other tasks. Additionally, the operator may shorten the jogging time therein not allowing sufficient vibration to align the documents 22. Finally, it is known that the operator may apply too much pressure in holding the batch therein preventing proper jogging and alignment.

It is therefore desirable to provide a jogger with adjustable bin width that can alleviate the above-referenced problems.

SUMMARY OF THE INVENTION

Accordingly, it is an object of the present invention to provide a jogger having an adjustable bin width.

Accordingly, it is also an object of the present invention to have a deck portion of a document jogger having at least one adjustable bin, the adjustable bin having an adjustably movable wall coupled to a floor opposite to a fixed wall, a variable space being defined by the adjustably movable wall, the fixed wall and the floor, the variable space being adapted for receiving documents.

BRIEF DESCRIPTION OF THE DRAWINGS

In order to appreciate the manner in which the advantages and objects of the invention are obtained, a more particular description of the invention will be rendered by reference to specific embodiments thereof which are illustrated in the appended drawings. Understanding that these drawings only depict and illustrate an embodiment of the present invention and are not therefore to be considered limiting in scope, the invention will be described and explained with additional specificity and detail through use of the accompanying drawings in which.

DETAILED DESCRIPTION OF A PREFERRED EMBODIMENT

Figure 1:
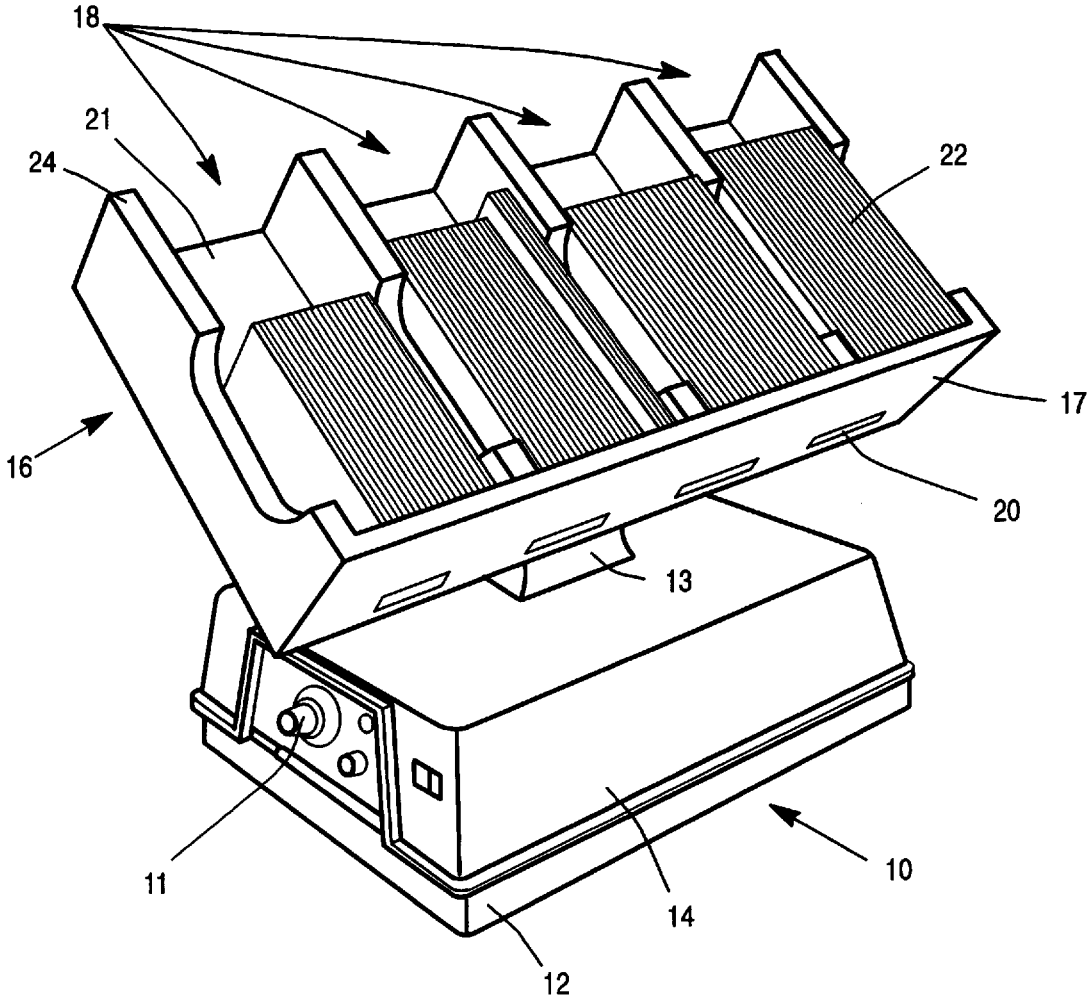
Figure 1 Prior Art
FIG. 1 is a perspective view of a prior art document jogger.
Figure 2:
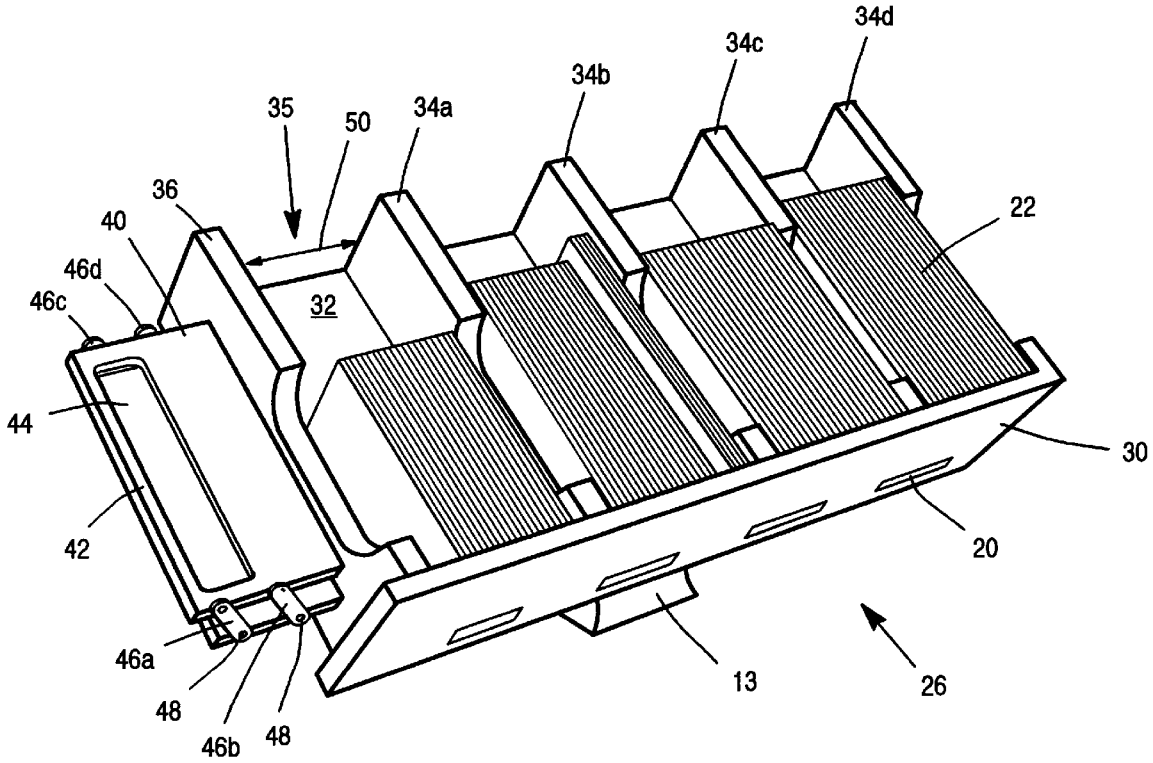
FIG. 2 is a perspective view a document jogger having an adjustable bin arranged in accordance with the principles of the invention.

The present invention is directed toward a deck portion 26 of a document jogger (such as 10 of FIG. 1) having at least one adjustable bin 35 as illustrated in FIG. 2. The deck portion 26, in accordance with the illustrated embodiment of FIG. 2, is mounted to a column 13. It should be understood that the column 13 as illustrated in FIG. 1 and the base 12, the housing 14 and all other elements of the jogger 10, with the exclusion of the illustrated embodiments of FIGS. 2 and 3, and as described herein are as described and illustrated in FIG. 1.

Returning to FIG. 2, the deck portion 26 has a deck floor 32. The deck portion 26 includes a wall 30 such that, preferably, an acute angle is formed at the juncture of the wall 30 and the deck floor 32 for accepting documents 22. The deck portion 26 also has a plurality of substantially parallel fixed walls 34*a, b, c, d*, each of which is substantially perpendicular to both the deck floor 32 and wall 30. Opposite to and spaced apart from the deck wall 34*a* is a movable wall 36. The movable wall 36 is perpendicular to and free floating from the deck floor 32 and wall 30. The movable wall 36, the fixed wall 34*a*, the deck floor 32 and wall 30 define a bin 35 having an adjustably variable width 50.

Figure 3:
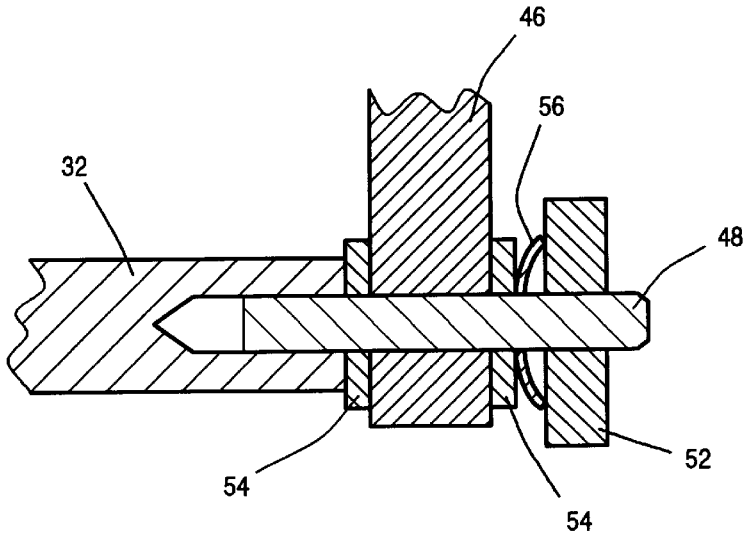
FIG. 3 is a cross-sectional view of a pivoting joint coupling a movable handle portion of a movable wall to a base wall of the document jogger of FIG. 2.

With reference to FIGS. 2 and 3, a plate 40 having a slot 44 forming a handle 42 is coupled to movable wall 36, and is pivotally connected at each of its ends to the deck floor 32 via two parallel links 46*a, b, c, d* that are of equal length. It should be understood that plate 40 may comprise a separate piece attached to movable wall 36, or plate 40 could comprise an integral extension of movable wall 36. Parallel links 46*a* and *b* are shown and parallel links 46*c* and *d*, are partially hidden in FIG. 2. It should be understood that the parallel links 46*a, b, c, d* are, preferably, identical in all respects. The parallel links 46*a, b, c, d* are pivotally mounted to the plate 40 and the deck floor 32 via pivot shafts 48. The pivot shafts 48 are threaded at one end and designed to anchor into either the deck floor 32 or the plate 40 (See FIG. 3). The distance between the pivot shafts 48 on the plate 40 is equal to the distance between the pivot shafts 48 on the deck floor 32. The parallel links 46*a, b, c, d* are held in place via nuts 52. The nuts 52 are threadably connected to the pivot shafts 48. In order to facilitate movement, the parallel links 46*a, b, c, d* are spaced apart from the deck floor 32 and the plate 40 via thrust washers 54. Friction is introduced in the system in order to hold the parallel links 46*a, b, c, d* in place by spring washers 56 that are compressed by rotating nuts 52 thereby exerting pressure on thrust washers 54 therein holding parallel links 46*a, b, c, d* in place. Thus, the force between parallel links 46*a, b, c, d* and thrust washers 54 provide a friction force which must be overcome in order to pivotally rotate parallel links 46*a, b, c, d*. The nuts 52 therein provide an adjustable force to account for variation in friction coefficients and variation in deck vibration amplitude. It should be understood that up to three of the pivot shafts 48 may be fixed so that they are not adjustable by a nut 52 but can freely rotate. Additionally, it should be understood that other methods of providing adjustable movement of movable wall 36 may be used including, for example, mounting movable wall 36 to linear guideways formed in deck floor 32. Any mechanical connection of movable wall 36 to deck floor 32 is equivalent to the linkage set forth in FIG. 2, so long as movable wall 36 may be moved relative to bin portion 26 such that movable wall 36 remains substantially parallel to fixed wall 34*a*.

In operation, referring to FIGS. 2 and 3, a batch of documents 22 is placed into the variable width bin 35. The plate 40 is moved along a predetermined linear path by the operator grasping the handle 42 and utilizing the slot 44. The movable wall 36 is adjusted into position such that the documents 22 are held snugly in place in the variable width bin 35. When an appropriate position is achieved, the bin portion 26 is ready for document jogging.

Those skilled in the art can now appreciate from the foregoing description that the broad teachings of the present invention can be implemented in a variety of forms. For example, deck portion 26 could include more than one bin having adjustable width. Therefore, while this invention has been described in connection with particular examples thereof, the true scope of the invention should not be so limited since other modifications will become apparent to the skilled practitioner upon study of the drawings, specification and the following claims.

What is claimed is:

1. A deck portion of a document jogger having at least one adjustable bin comprising:

a floor adapted for mounting to a document jogger;

an adjustably movable wall coupled to said floor;

a fixed wall opposite and substantially parallel to said adjustable wall;

a variable space defined by said adjustably movable wall, said fixed wall and said floor, such that said variable space is adapted for receiving document stacks of variable lengths running from said fixed wall to said adjustably movable wall; and a rotational member for adjustable moving said adjustable wall, said rotational member having a biasing means for controlling the adjustment of said adjustable wall.

2. The adjustable bin according to claim 1 wherein said adjustable wall further comprises a handle portion for use by an operator in varying said variable space.

3. The adjustable bin according to claim 2 wherein said handle portion is coupled to the floor via said rotational member, said rotational member comprising at least one parallel linkage, said parallel linkage being mounted to said floor and said handle portion via pivot shafts.

4. A deck portion of a document jogger having at least one adjustable bin comprising:

a floor adapted for mounting to a document jogger;

a wall in contact with said floor such that an angle is formed;

a fixed wall in contact with said floor and said wall; and a movable wall opposite to and spaced apart from said fixed wall such that said fixed wall and said movable wall define a variable space, said movable wall being movable along a predetermined path wherein said movable wall comprises a rotatable means for guiding said movable wall along said predetermined path, said rotatable means for guiding comprising a locking means.

5. The adjustable bin according to claim 4 wherein said movable wall further comprises a handle portion connected to said movable wall.

6. A deck portion of a document jogger having at least one adjustable bin comprising:

a floor adapted for mounting to a document jogger;

a wall mounted perpendicularly to said floor, said floor being inclined so that it extends upwardly from its intersection with said wall;

a fixed wall perpendicular to said floor and perpendicular to said wall;

a movable wall spaced apart from said fixed wall, said movable wall being perpendicular to and free floating from said floor and said wall, said movable wall being pivotally mounted to said floor, said movable wall travelling along a predetermined path; and a biasing member for applying a transverse force to said movable wall and said floor.

7. The adjustable bin according to claim 6 wherein said pivotal mount further comprises a plurality of parallel links, said parallel links being rotationally mounted to said movable wall and said deck floor via pivot shafts.

8. The adjustable bin according to claim 7 wherein said biasing member is a spring.

9. A deck portion of a document jogger having at least one adjustable bin comprising:

a floor adapted for mounting to a document jogger;

a wall mounted perpendicularly to said floor, said floor being inclined so that it extends upwardly from its intersection with said wall;

a fixed wall perpendicular to said floor and perpendicular to said wall; and a movable wall spaced apart from said fixed wall, said movable wall being perpendicular to and free floating from said floor and said wall, said movable wall being pivotally mounted to said floor, said pivotal mount comprising a plurality of parallel links, said parallel links being rotationally mounted to said movable wall and said deck floor via pivot shafts, said pivot shafts further comprising a spring for applying a biasing force to said parallel links such that said movable wall travels along a predetermined path.

* * * * *